US011499259B2

(12) United States Patent
Bixby et al.

(10) Patent No.: US 11,499,259 B2
(45) Date of Patent: Nov. 15, 2022

(54) DETACHABLE PRETREAT SINK FOR LAUNDRY APPLIANCE HAVING AN OPERABLE WASHBOARD

(71) Applicant: WHIRLPOOL CORPORATION, Benton Harbor, MI (US)

(72) Inventors: Seth E. Bixby, Stevensville, MI (US); Sayer J. Murphy, St. Joseph, MI (US); Giuseppe Netti, Varese (IT); Jun Young Park, Benton Harbor, MI (US); Jeremy D. Watkins, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 71 days.

(21) Appl. No.: 17/027,802

(22) Filed: Sep. 22, 2020

(65) Prior Publication Data

US 2021/0108348 A1 Apr. 15, 2021

Related U.S. Application Data

(60) Provisional application No. 62/915,316, filed on Oct. 15, 2019.

(51) Int. Cl.

| | |
|---|---|
| ***D06F 29/00*** | (2006.01) |
| ***D06F 3/02*** | (2006.01) |
| ***D06F 39/14*** | (2006.01) |

(52) U.S. Cl.

CPC ..... *D06F 29/00* (2013.01); *D06F 3/02* (2013.01); *D06F 39/14* (2013.01)

(58) Field of Classification Search

CPC ..... D06F 29/00; D06F 3/02; D06F 39/14
USPC ..... 68/4
See application file for complete search history.

(56) References Cited

U.S. PATENT DOCUMENTS

| | | | |
|---|---|---|---|
| 3,209,560 | A | 10/1965 | Shelton |
| 5,253,493 | A | 10/1993 | Ohashi |
| 7,814,768 | B2 | 10/2010 | Vecchi et al. |
| 9,340,915 | B2 | 5/2016 | Kim et al. |
| 9,873,973 | B2 | 1/2018 | Park et al. |
| 10,047,474 | B2 | 8/2018 | Park et al. |
| 10,119,218 | B2 | 11/2018 | Han et al. |
| 10,125,443 | B2 | 11/2018 | Kim |
| 10,167,588 | B2 | 1/2019 | Kim et al. |
| 10,273,620 | B2 | 4/2019 | Kim |
| 10,280,548 | B2 | 5/2019 | Leibman et al. |
| 10,287,722 | B2 | 5/2019 | Kim et al. |
| 10,301,763 | B2 | 5/2019 | Kim et al. |
| 2015/0211163 | A1* | 7/2015 | Jin et al. ..... D06F 37/30 68/133 |

(Continued)

*Primary Examiner* — Tinsae B Ayalew
(74) *Attorney, Agent, or Firm* — Price Heneveld LLP

(57) ABSTRACT

A laundry appliance includes an outer cabinet having a top panel that defines an aperture for accessing an interior of the cabinet. A tub is positioned within the outer cabinet and below the aperture. A rotating drum disposed within the tub. A pretreat basin is selectively positioned in an installed position relative to the top panel and above the drum. The pretreat basin has an outer frame and a pivoting central portion that rotationally operates within the outer frame between a sealed position defined by the pivoting central portion being in alignment with the outer frame and a rotated position defined by the pivoting central portion being rotated out of alignment with the outer frame.

20 Claims, 12 Drawing Sheets

(56) References Cited

U.S. PATENT DOCUMENTS

| | | | | |
|---|---|---|---|---|
| 2015/0275412 | A1* | 10/2015 | Kim | D06F 23/04 68/27 |
| 2018/0216281 | A1 | 8/2018 | Pollett et al. | |
| 2018/0347101 | A1 | 12/2018 | Park et al. | |
| 2019/0032270 | A1 | 1/2019 | Kim et al. | |
| 2019/0040565 | A1 | 2/2019 | Kim | |
| 2019/0071808 | A1 | 3/2019 | Kim et al. | |
| 2019/0071815 | A1 | 3/2019 | Woodham, Jr. et al. | |
| 2019/0177905 | A1* | 6/2019 | Ayers | D06F 58/04 |
| 2019/0218700 | A1 | 7/2019 | Kim et al. | |

* cited by examiner

DETACHABLE PRETREAT SINK FOR LAUNDRY APPLIANCE HAVING AN OPERABLE WASHBOARD

CROSS-REFERENCE TO RELATED APPLICATION

This application claims priority to and the benefit under 35 U.S.C. § 119(e) of U.S. Provisional Patent Application No. 62/915,316, filed on Oct. 15, 2019, entitled DETACHABLE PRETREAT SINK FOR LAUNDRY APPLIANCE HAVING AN OPERABLE WASHBOARD, the entire disclosure of which is hereby incorporated herein by reference.

FIELD OF THE DEVICE

The device is in the field of laundry appliances, and more specifically, a detachable pretreat sink fora laundry appliance.

SUMMARY

According to one aspect of the present disclosure, a laundry appliance includes an outer cabinet having a top panel that defines an aperture for accessing an interior of the cabinet. A tub is positioned within the outer cabinet and below the aperture. A rotating drum disposed within the tub. A pretreat basin is selectively positioned in an installed position relative to the top panel and above the drum. The pretreat basin has an outer frame and a pivoting central portion that rotationally operates within the outer frame between a sealed position defined by the pivoting central portion being in alignment with the outer frame and a rotated position defined by the pivoting central portion being rotated out of alignment with the outer frame.

According to another aspect of the present disclosure, a laundry appliance includes an outer cabinet having a top panel that defines an aperture for accessing an interior of the cabinet. A tub is positioned within the interior and below the aperture. A rotating drum is disposed within the tub. The rotating drum has a balancing ring at a top edge of the drum and proximate the aperture. A pretreat basin is selectively positioned in an installed position on one of the top panel and the balancing ring. The pretreat basin has an outer frame and a pivoting central portion that rotationally operates within the outer frame between an aligned sealed position and an oblique rotated position.

According to yet another aspect of the present disclosure, a pretreat basin for a laundry appliance includes an outer frame that is selectively positioned over a processing chamber of said laundry appliance. A pivoting central portion is rotationally disposed within the outer frame and rotates about a pivot axis. The pivoting central portion rotationally operates between a sealed position characterized by the pivoting central portion being in alignment with the outer frame and a rotated position characterized by the pivoting central portion being rotated out of alignment with the outer frame. A sidewall extends between the outer frame and the pivoting central portion.

These and other features, advantages, and objects of the present disclosure will be further understood and appreciated by those skilled in the art by reference to the following specification, claims, and appended drawings.

Figure 1:
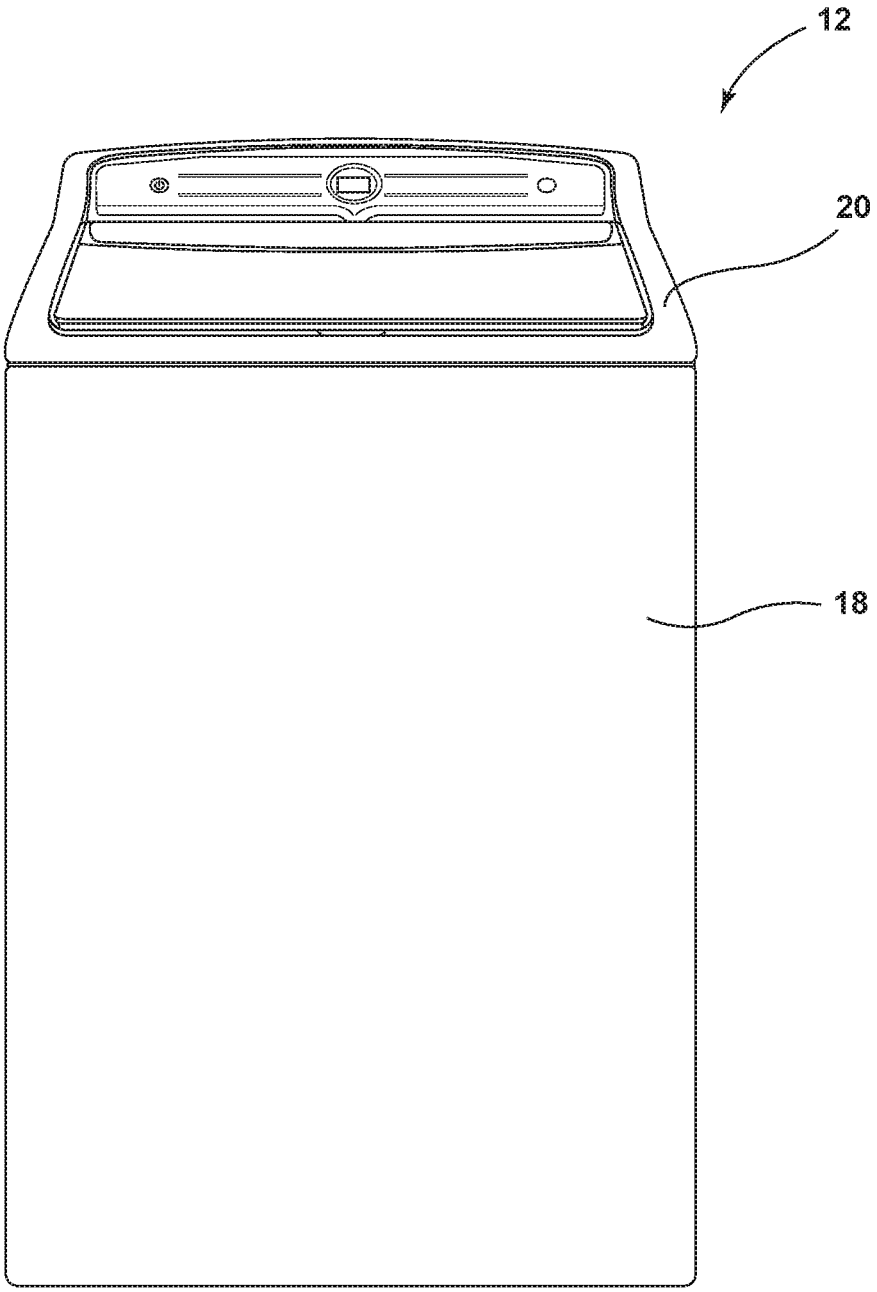
FIG. 1 is a front perspective view of a laundry appliance that can be used for receiving an aspect of a detachable pretreat sink.

The components in the figures are not necessarily to scale, emphasis instead being placed upon illustrating the principles described herein.

DETAILED DESCRIPTION

The present illustrated embodiments reside primarily in combinations of method steps and apparatus components related to a pretreating basin for use within a laundry appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-8, reference numeral 10 generally refers to a pretreat basin that can be disposed within a laundry appliance 12 for pretreating certain articles 14 of clothing before being disposed within a rotating drum 16 to be washed. According to various aspects of the device, the laundry appliance 12 includes an outer cabinet 18 having a top panel 20 that defines an aperture 22 for accessing an interior 24 of the outer cabinet 18. A tub 26 is positioned within the interior 24 of the outer cabinet 18 and below the aperture 22. The rotating drum 16 is disposed within the tub 26. The rotating drum 16 includes a balancing ring 28 at the top edge 30 of the drum 16 and near the aperture 22. The pretreat basin 10 is adapted to selectively rest on one of the top panel 20 and the balancing ring 28 to define an installed position 32. The pretreat basin 10 includes an outer frame 34 that rests upon one of the top panel 20 and the balancing ring 28. The pretreat basin 10 also includes a pivoting or rotating central portion 36 that rotationally operates within the outer frame 34 between a sealed position 38 and a rotated position 40 with the outer frame 34 resting on either the top panel 20 or the balancing ring 28. The pretreat basin 10 is selectively installable in the installed position 32 over the rotating drum 16 for the appliance 12. Additionally, the pretreat basin 10 can be moved to a stowed position 42 away from the aperture 22. Typically, this stowed position 42 is attached to the laundry appliance 12, such as at the side panel of the outer cabinet 18 for the laundry appliance 12 through a magnetic or hanging attachment.

Referring again to FIGS. 1-8, where the pretreat basin 10 is installed on the balancing ring 28 for the laundry appliance 12, the entire pretreat basin 10, or substantially the entire pretreat basin 10, is positioned within the aperture 22 and below the top panel 20 for the outer cabinet 18. In this manner, the entire outer frame 34 for the pretreat basin 10 is disposed within the aperture 22, such that as a user pretreats a certain article 14 of clothing, fluid used for pretreating the article 14 can be maintained within the aperture 22 and over the rotating drum 16 for the appliance 12. Typically, an opening 50 into the drum 16 is defined by the balancing ring 28, and the pretreat basin 10 can be coupled with the balancing ring 28 to define the installed position 32.

The pretreat basin 10 includes the outer frame 34 and the rotating central portion 36 that is set within the outer frame 34. The rotating central portion 36 includes a pivot axis 52 that extends laterally through a portion of the outer frame 34. The rotating central portion 36 can be locked in the sealed position 38 such that water can be contained within a pretreating volume 54 defined within the outer frame 34 and above the rotating central portion 36. The rotating central portion 36 can be secured within the sealed position 38 through various locking, detent or snapping mechanisms that maintain a continuous seal 56 around the outer edge 58 of the rotating central portion 36 and an inner perimeter 60 of the outer frame 34 to maintain the seal 56. An elastomeric member 62 can extend between the rotating central portion 36 and the outer frame 34 to maintain the sealing engagement that is defined by the sealed position 38 of the rotating central portion 36. In various aspects of the device, the outer frame 34 can be made of an elastomeric material that integrally forms the elastomeric member 62 that forms the seal 56 when the rotating central portion 36 is in the sealed position 38.

To allow for pouring or sliding of the articles 14 and fluid into the rotating drum 16, the rotating central portion 36 can be rotated from the sealed position 38, aligned with the outer frame 34, to a rotated position 40, oblique to the outer frame 34, while the outer frame 34 is maintained in a stable position over the opening 50 into the drum 16. By moving the rotating central portion 36 to the rotated position 40, a top surface 70 of the rotating central portion 36 is positioned out of alignment with the outer frame 34 and at least at an angle of repose for fluid and articles 14. Using this configuration, the articles 14 of clothing being pretreated and any fluid contained on the rotating central portion 36 can be poured or slid into the rotating drum 16 using the force of gravity and without moving the outer frame 34 away from the installed position 32.

It is contemplated that during a pretreating phase of a laundry operation, a user may pretreat several articles 14 of clothing within the pretreat basin 10. After each article 14 is pretreated, the user can rotate the rotating central portion 36 to the rotated position 40 and slide the article 14 of clothing into the rotating drum 16. The rotating central portion 36 can then be moved back into the sealed position 38 and the next article 14 of clothing can be pretreated. This operation can be repeated for the various articles 14 to be pretreated without removing the outer frame 34 of the pretreat basin 10 from the installed position 32. Because the sealed position 38 that can be defined between the rotating central portion 36 and the frame is substantially watertight, the user can also remove the pretreat basin 10 from the installed position 32 and pour soiled water resulting from the pretreatment phase into a separate drain such as utility sink, or other similar waste-type drain.

Certain pretreatment chemistries that are used for pretreating articles 14 can be useful in treating an entire load of laundry, including the pretreated articles 14. Accordingly, use of the rotating central portion 36 for pouring the articles 14 that have been pretreated along with the pretreatment chemistries into the rotating drum 16 can be useful for performing a laundry operation.

According to various aspects of the device, as exemplified in FIGS. 2-8, the pretreat basin 10 can be positioned on the balancing ring 28 to define the installed position 32. In such an embodiment, the installed position 32 of the pretreat basin 10 is typically below a fluid port 80 for the appliance 12 for delivering fluid into the rotating drum 16. This fluid port 80 can be used for providing fluid into the pretreating volume 54 that is defined above the rotating central portion 36 in the sealed position 38. Accordingly, a separate fluid source is not typically needed for conducting a pretreatment operation within the pretreat basin 10. Additionally, because laundry appliances 12 typically have access to hot and cold water sources, the temperature of the water being used within the pretreating volume 54 of the pretreat basin 10 can be likewise adjusted depending upon the type of pretreatment being conducted within the laundry appliances 12.

Figure 9:
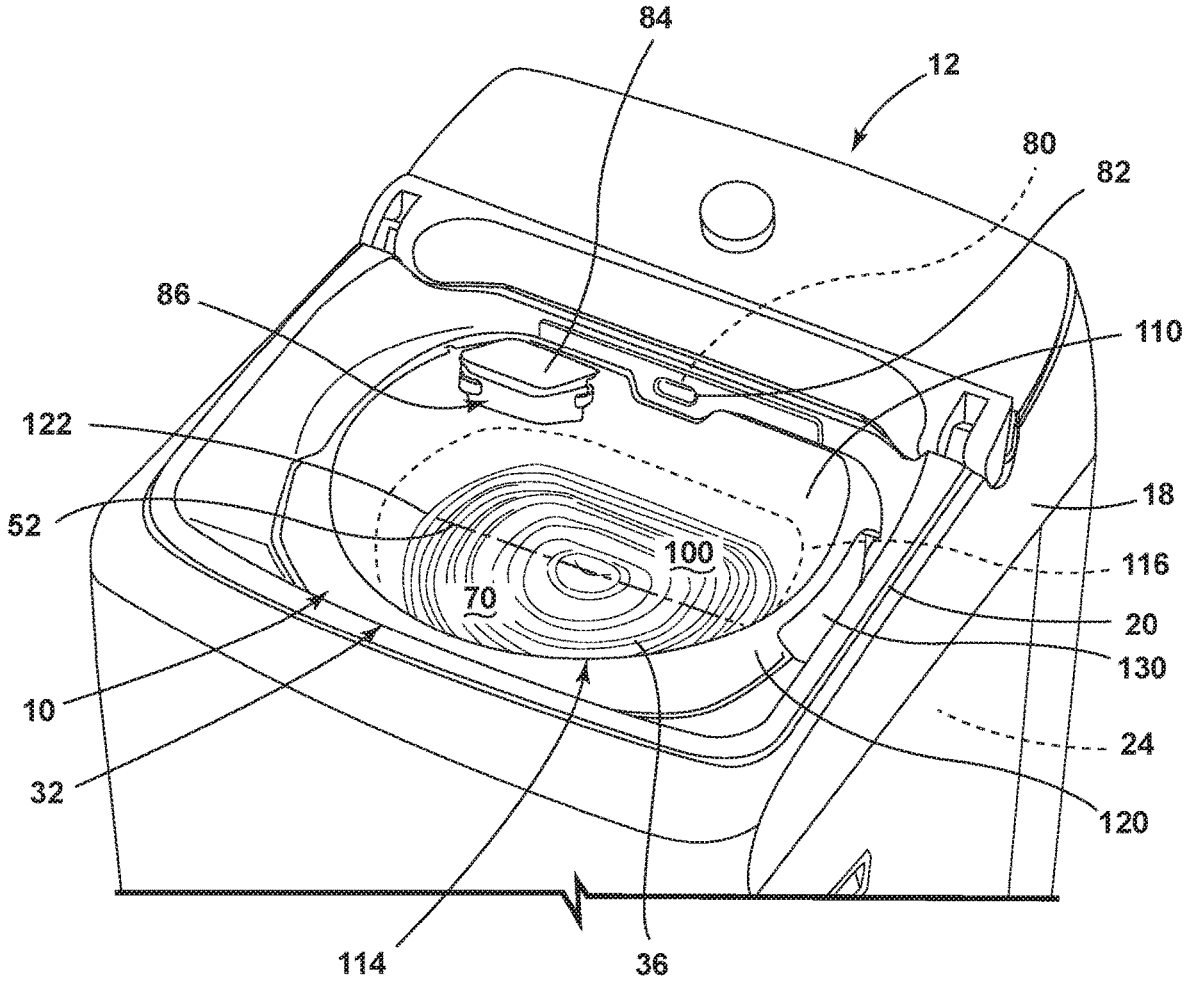
FIG. 9 is a top perspective view of a laundry appliance with the rotatable lid removed and showing installation of the pretreat sink within a top panel of the laundry appliance.
Figure 10:
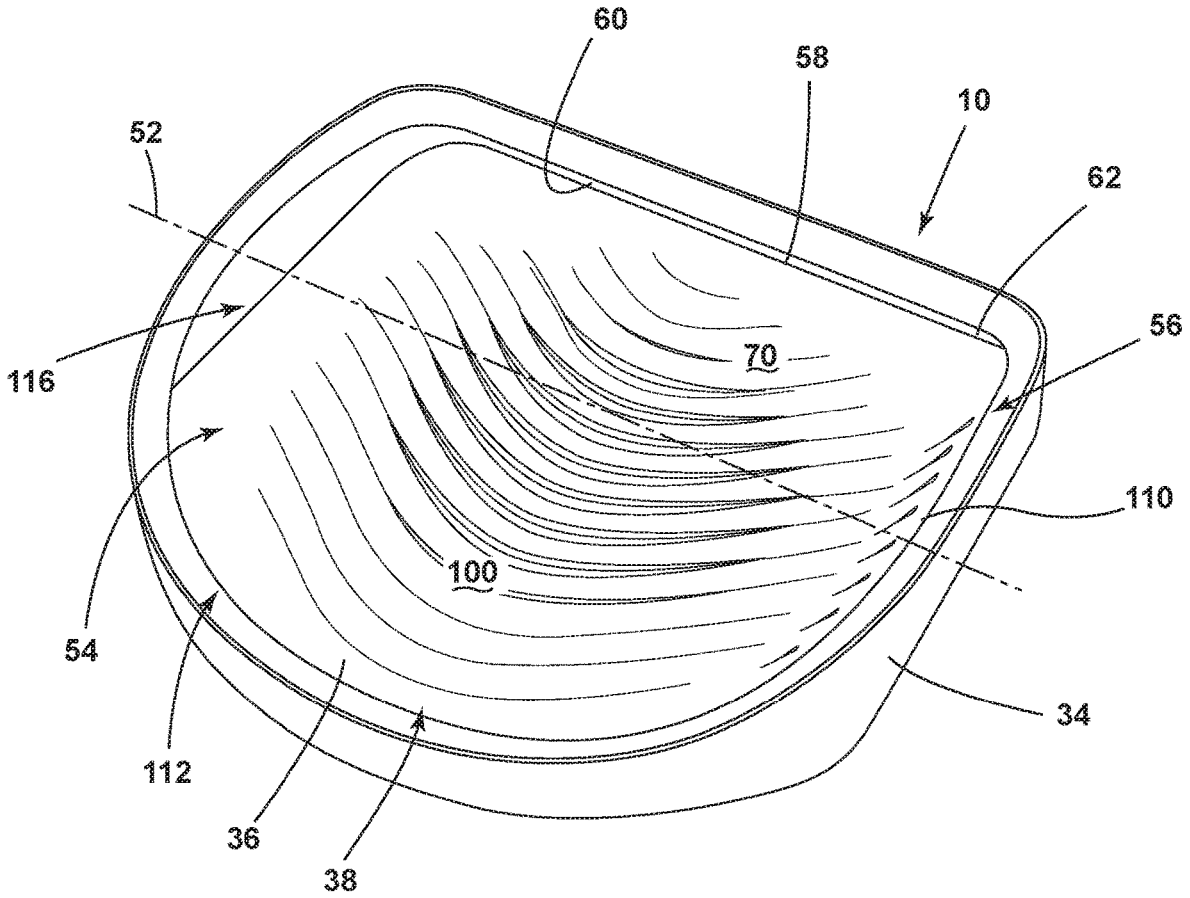
FIG. 10 is a top perspective view of an aspect of the pretreat sink.
Figure 11:
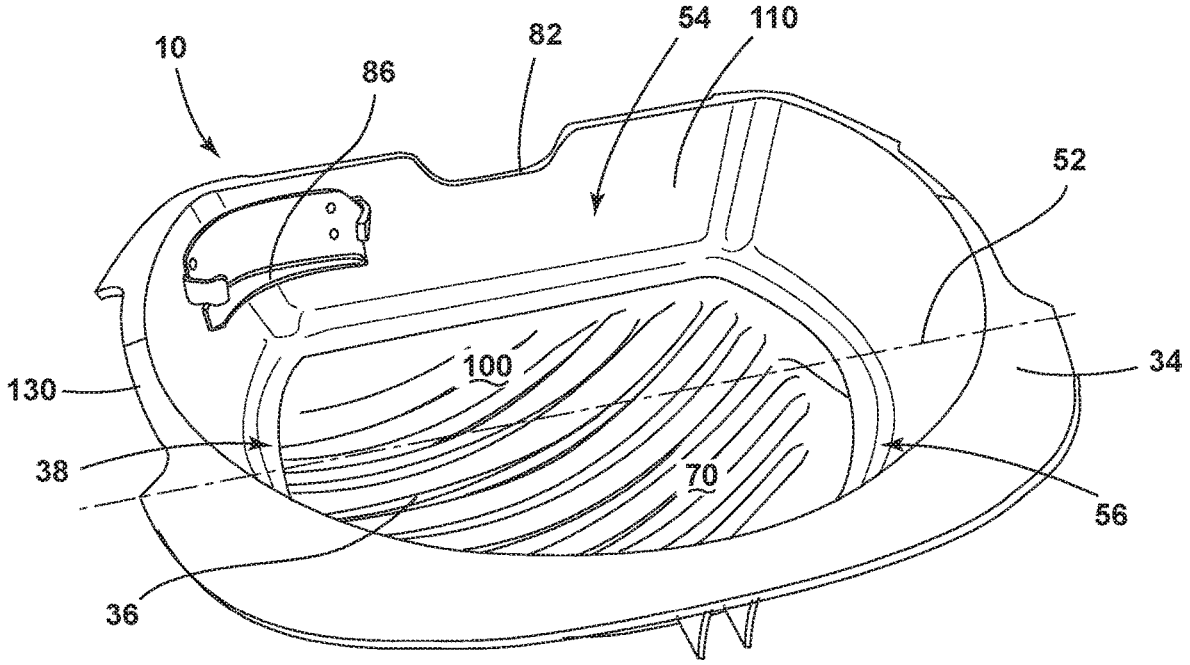
FIG. 11 is a top perspective view of an aspect of the pretreat sink.
Figure 12:
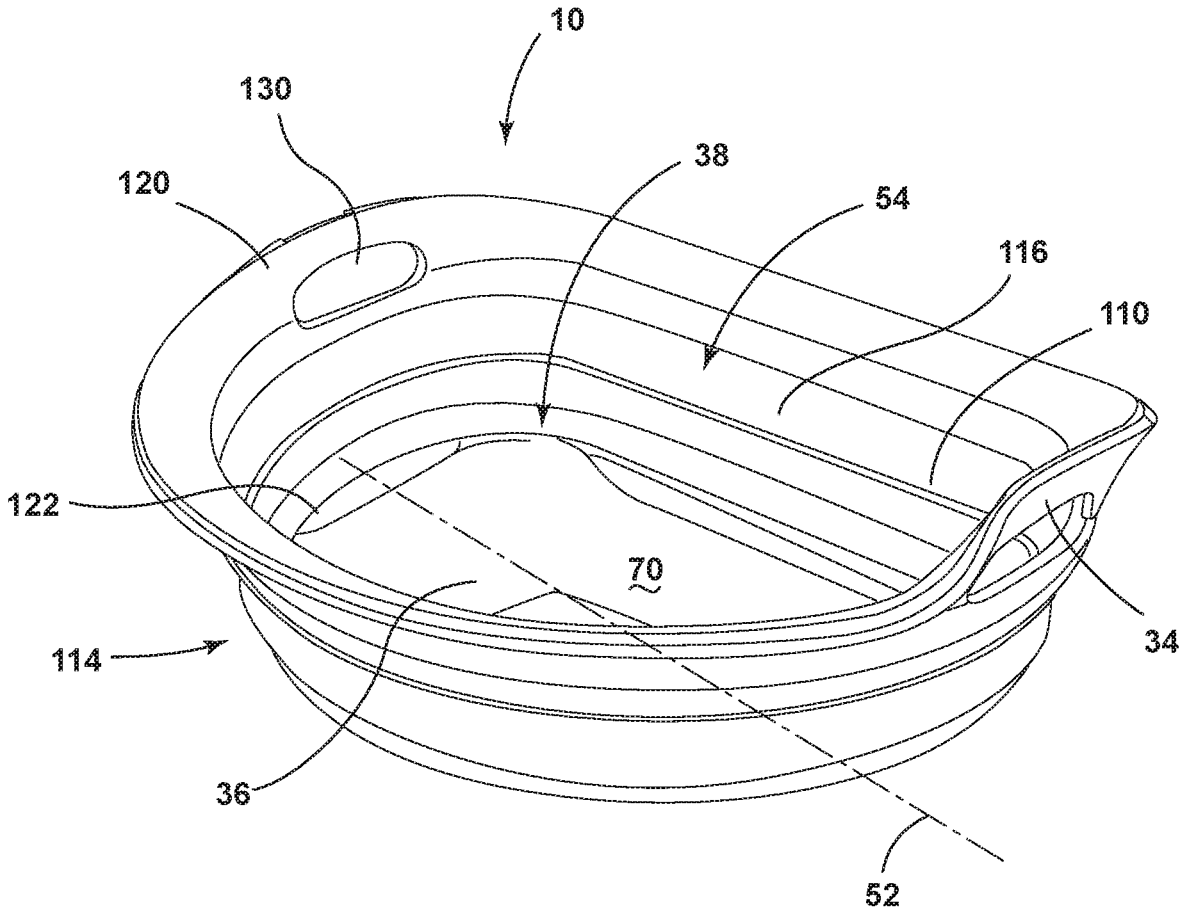
FIG. 12 is a top perspective view of an aspect of the pretreat sink and illustrating a flexible sidewall for raising and lowering the rotatable central portion.

Referring now to FIG. 9, the pretreat basin 10 can also be installed within the aperture 22 of the top panel 20. In such an embodiment, the pretreat basin 10 extends over a portion of the aperture 22 and rests upon the top panel 20. The rotating central portion 36 can extend downward from the top panel 20 and is typically extendable into the area defined within the rotating drum 16. Accordingly, the pretreat basin 10 can define an adjustable and significant pretreating volume 54 within which pretreatment operations can be conducted.

The pretreat basin 10 can include various facilities for operating in combination with portions of a laundry appliance 12. By way of example, and not limitation, where the pretreat basin 10 rests upon the top panel 20, the pretreat basin 10 can include a fluid conduit 82 that operates in combination with the fluid port 80 for the laundry appliance 12. The fluid conduit 82 can be positioned to allow the fluid port 80 to dispose fluid, typically water, through the fluid conduit 82 and into the pretreating volume 54 of the pretreat basin 10. The pretreat basin 10 can also include various utility features such as a pretreat brush 84, and a receptacle 86 for receiving the pretreat brush 84.

As exemplified in the various aspects of the device, the pretreat basin 10 can include the rotating central portion 36 that is operable between the sealed position 38 and the rotated position 40. It is also contemplated that the rotating central portion 36 can include an at least partially translucent material that allows a user to view within the rotating drum 16 to determine how much space is available within the rotating drum 16 for performing a particular laundry operation. The top surface 70 of the rotating central portion 36 can also include a textured surface 100 that can provide a washboard-style agitating functionality for conducting various pretreat operations within the pretreating volume 54 of the pretreat basin 10.

As discussed above, the rotating central portion 36 in the sealed position 38 is typically disposed at a height that is below a top surface 70 of the drum 16 and within a processing chamber 102 of the rotating drum 16. Again, this vertical positioning of the rotating central portion 36 in the sealed position 38 assists in maintaining fluid within the aperture 22, thereby preventing spillage outside of the aperture 22 for the top panel 20.

Referring again to FIGS. 6-11, the textured surface 100 of the upper surface for the rotating central portion 36 can include various textures that can include, but are not limited to, ribs, protrusions, wave-type formations, and other similar textured surfaces 100 that can be used in providing the agitating function in performing the various pretreat operations.

According to various aspects of the device, the pretreat basin 10 can also include a flexible sidewall 110 that allows for manipulation of the rotating central portion 36 to be moved vertically between a collapsed position 112 and an expanded position 114. In the collapsed position 112, the flexible sidewall 110 includes a substantially folded configuration that places the top surface 70 of the rotating central portion 36 near the outer frame 34 of the pretreat basin 10. Using the manipulable features, such as pleats 116, of the flexible sidewall 110, the rotating central portion 36 can be operated downward to place the rotating central portion 36 within the processing chamber 102 defined by the rotating drum 16. To allow for the manipulation of the rotating central portion 36 between the collapsed and expanded positions 112, 114, the flexible sidewall 110 can include the operable pleats 116 that can be folded and unfurled to define each of the collapsed and expanded positions 112, 114. By expanding the pleats 116 of the flexible sidewall 110 to the expanded position 114, greater amounts of pretreating chemistries, greater amounts of fluid and greater amounts of articles 14 to be treated can be located within the pretreat basin 10.

It is contemplated that the flexible sidewall 110 can include multiple pleats 116 such that the rotating central portion 36 can be positioned in a progression of vertical positions between the collapsed and expanded positions 112, 114 where a portion of the plurality of pleats 116 may be unfurled while other pleats 116 may remain folded. In each of these configurations, it is contemplated that the rotating central portion 36 maintains its ability to rotate between the sealed position 38 and the rotated position 40 for sliding articles 14 and various fluids and chemistries into the processing chamber 102 defined within the rotating drum 16. In addition, the rotating central portion 36 may be maintained in the sealed position 38 so that used pretreating fluid and soiled water may be carried within the pretreat basin 10 and away from the appliance 12. In this manner, the used fluid can be disposed of in an external drain or other area away from the appliance 12.

Where the pretreat basin 10 includes the flexible sidewall 110, the flexible sidewall 110 can be disposed within the outer frame 34 and the sidewall 110 can extend between the primary frame 120 that rests upon a supporting substrate. Again, this supporting substrate is typically in the form of either the top panel 20 of the appliance 12 or the balancing ring 28 that is coupled to the tub 26 or the drum 16 of the laundry appliance 12. Additionally, the flexible sidewall 110 can extend downward to a pivot-retaining frame 122 that defines the pivoting engagement about which the rotating central portion 36 rotates between the sealed position 38 and the rotated position 40. The pivot-retaining frame 122 can also include the elastomeric member 62 to define a sealing engagement between the rotating central portion 36 and the sidewall 110 to define the sealed position 38 of the rotating central portion 36.

Referring again to FIGS. 3-12, the frame for the pretreat basin 10 can include one or more handles 130 that a user can use for grasping a pretreat basin 10 for moving between the installed position 32 and the stowed position 42. These handles 130 can be defined within the frame or can be attached thereto for manipulating the position of the pretreat basin 10.

According to various aspects of the device, and in particular, where the pretreat basin 10 rests upon the balancing ring 28 for the laundry appliance 12, the pretreat basin 10 can rest upon front and rear portions 140, 142 of the balancing ring 28. This configuration provides a grasping space 144 at the left and right sides 146, 148 of the pretreat basin 10 and between the pretreat basin 10 and the balancing ring 28 for allowing a user to grasp the frame for the pretreat basin 10 for moving it between the installed and stowed positions 32, 42. This configuration also allows for a viewing space 150 for the user where the rotating central portion 36 of the pretreat basin 10 may be opaque or difficult to view through because of the articles 14 being pretreated or the chemistries included therein. This positioning of the outer frame 34 on the front and rear portions 140, 142 of the balancing ring 28 also positions the pretreat basin 10 relative to the fluid port 80 for the laundry appliance 12. This position of the pretreat basin 10 provides a repeatable and consistent position of the pretreat basin 10 for disposing fluid within the pretreat volume of the pretreat basin 10.

According to various aspects of the device, the pretreat basin 10 can be made of various materials that can include, but are not limited to, plastic, various polymers, rubberized materials, metals, metal alloys, and other similar materials that can be used within laundry appliances 12 for treating and pretreating various articles 14 to be processed within the processing chamber 102 of the rotating drum 16.

Figure 2:
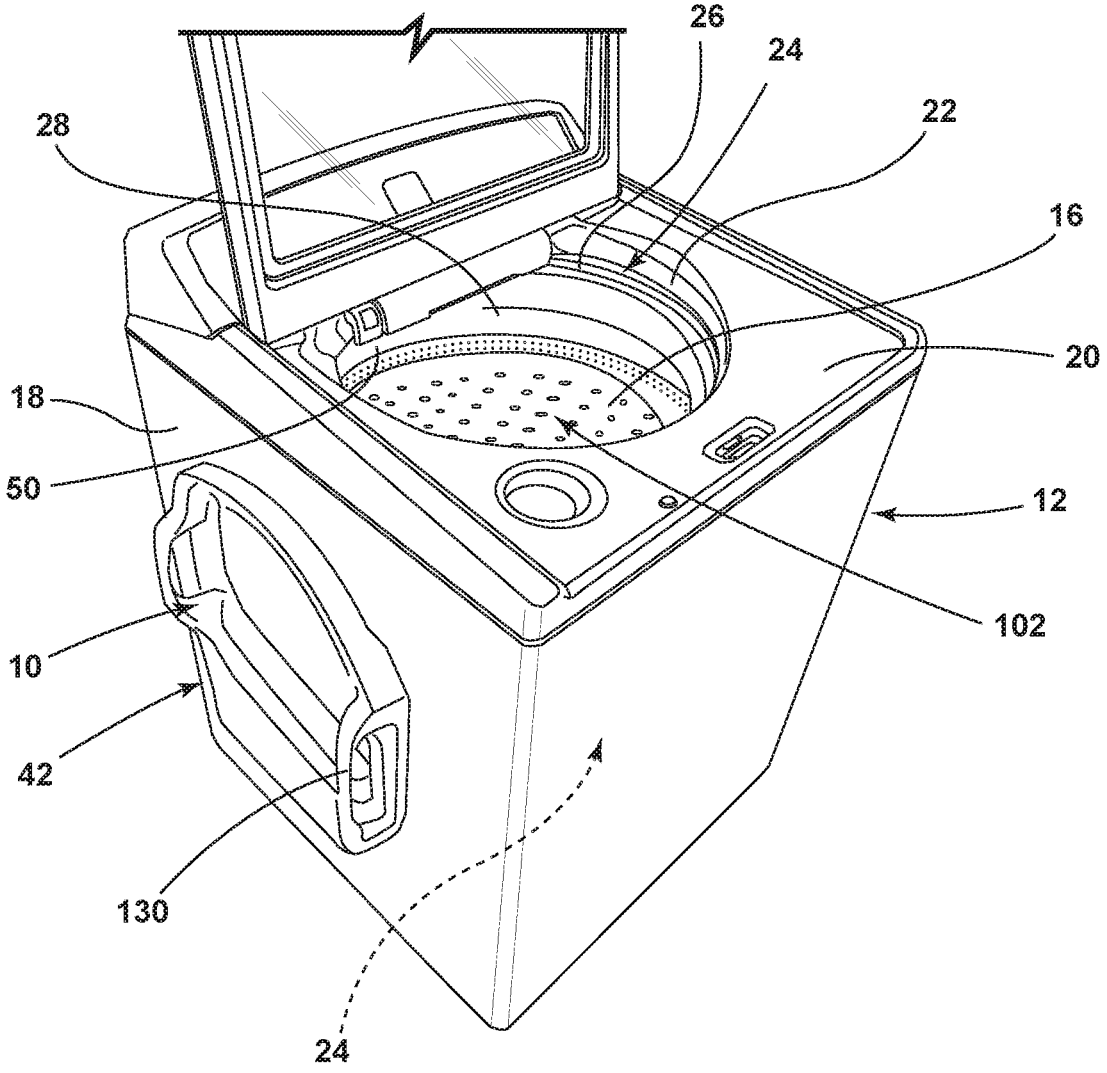
FIG. 2 is a top perspective view of a laundry appliance showing the detachable pretreat sink in a stowed position attached to a side of the laundry appliance.
Figure 3:
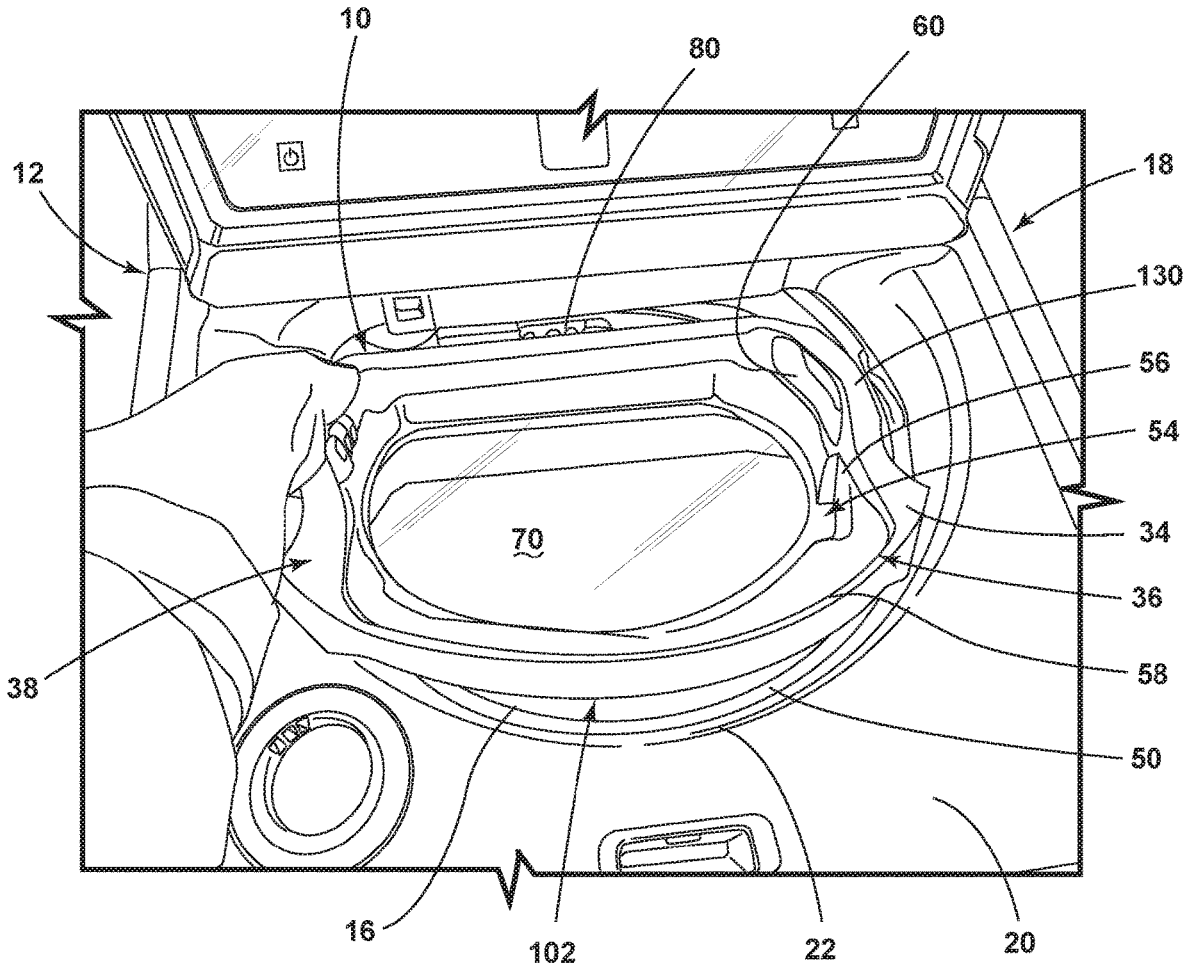
FIG. 3 is a top perspective view of the laundry appliance of FIG. 2 and showing an aspect of the detachable pretreat sink being disposed within the laundry appliance.
Figure 4:
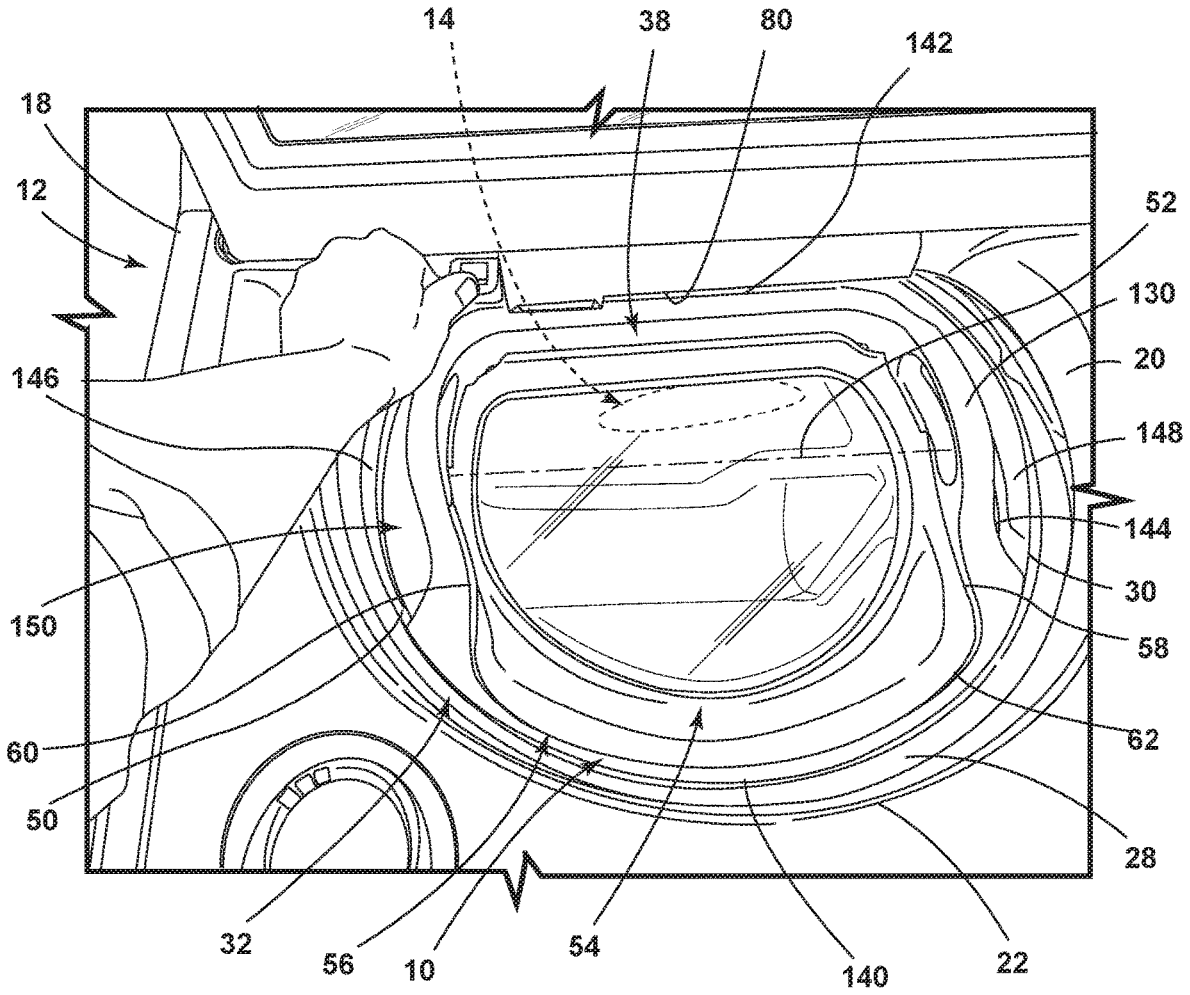
FIG. 4 is a top perspective view of the laundry appliance of FIG. 3 and showing the detachable pretreat sink in an installed position.
Figure 5:
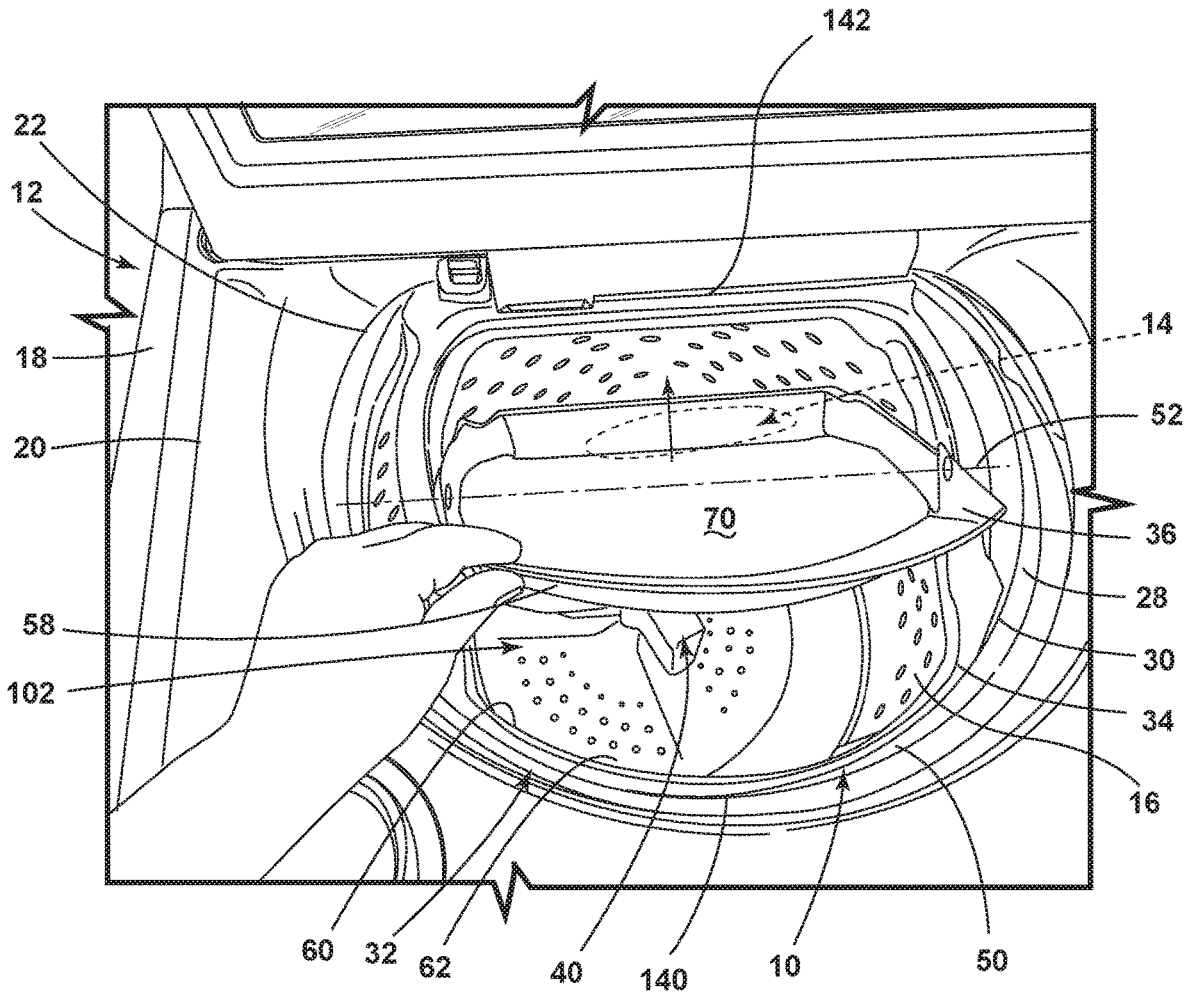
FIG. 5 is a top perspective view of the laundry appliance of FIG. 4 and showing the central operable portion in a rotated position.
Figure 6:
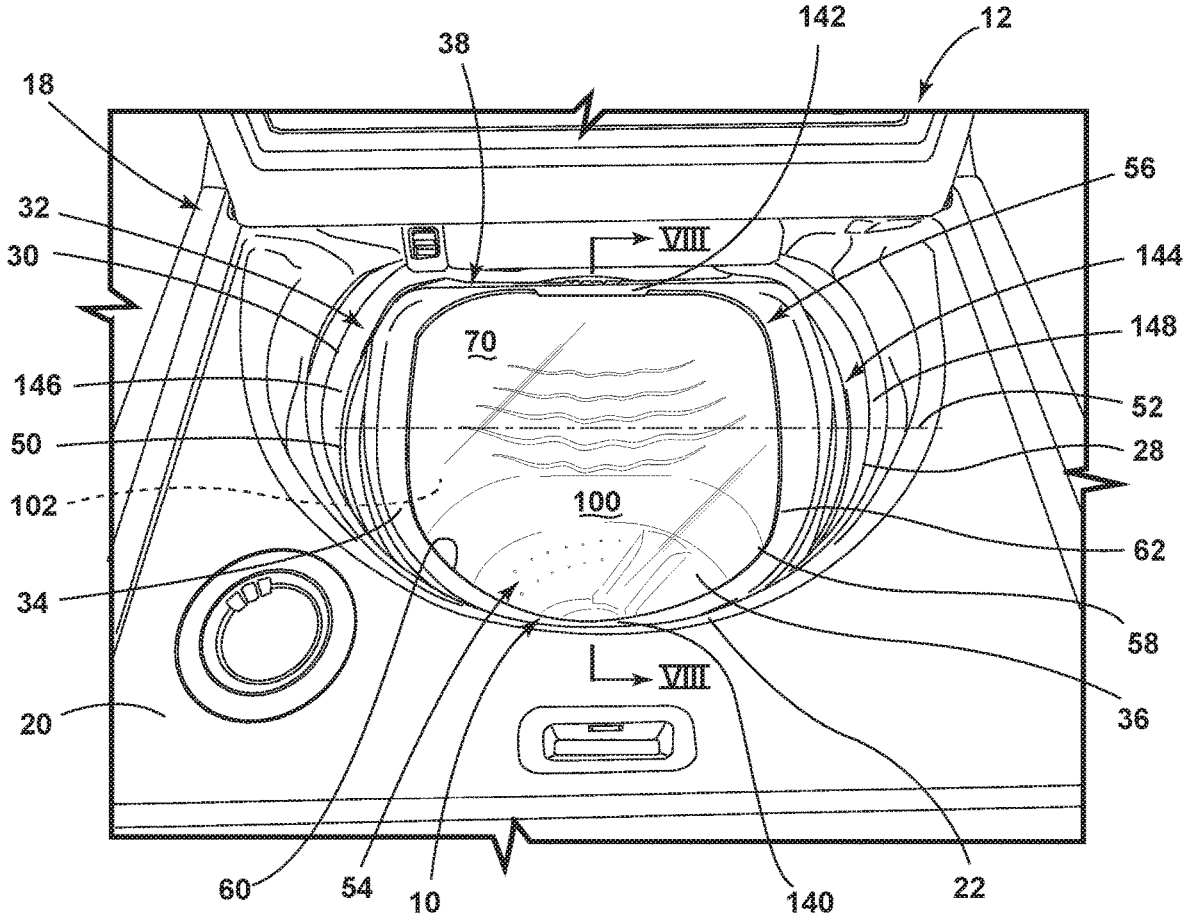
FIG. 6 is a top perspective view of the laundry appliance of FIG. 2 showing an alternative aspect of the detachable pretreat sink in an installed position.
Figure 7:
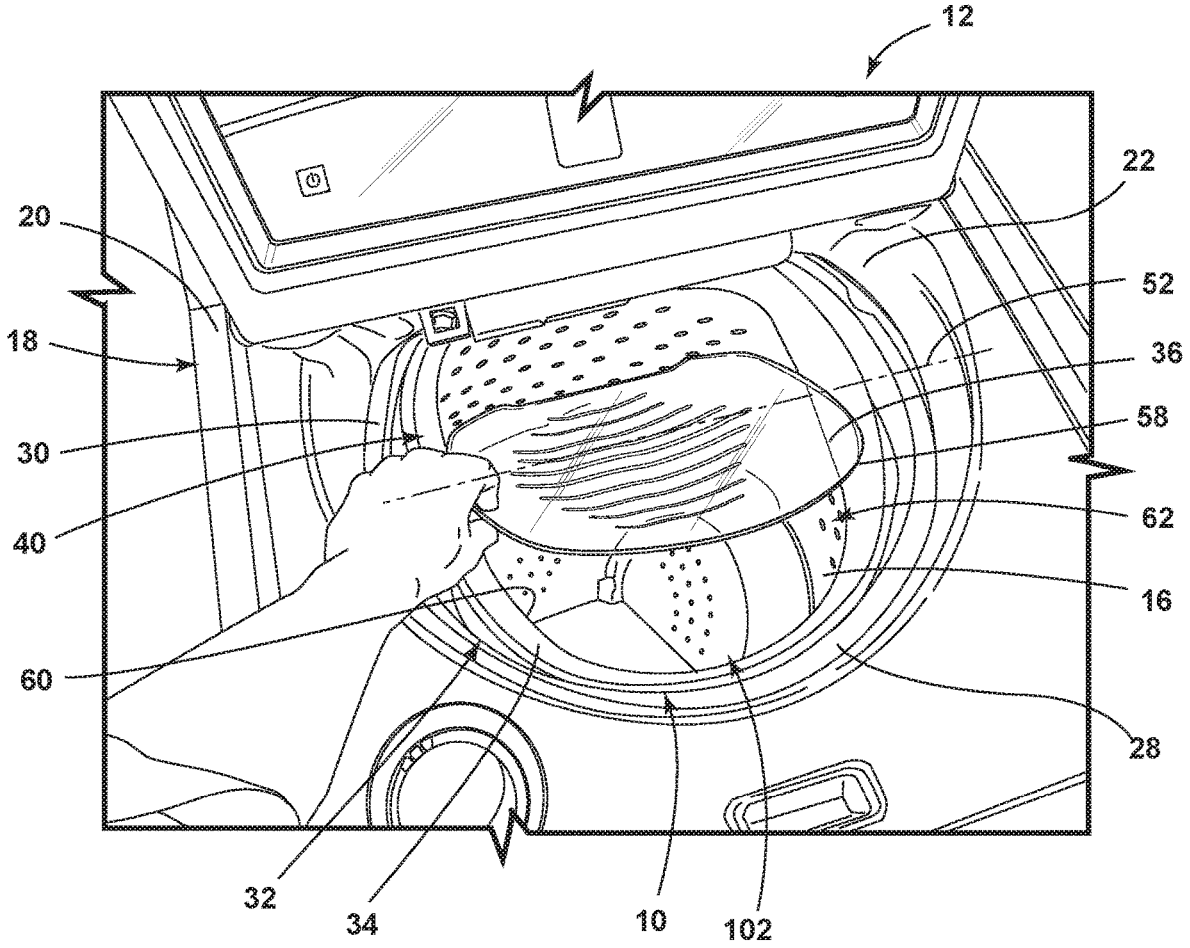
FIG. 7 is a top perspective view of the laundry appliance of FIG. 6 and showing the central portion in the rotated position.
Figure 8:
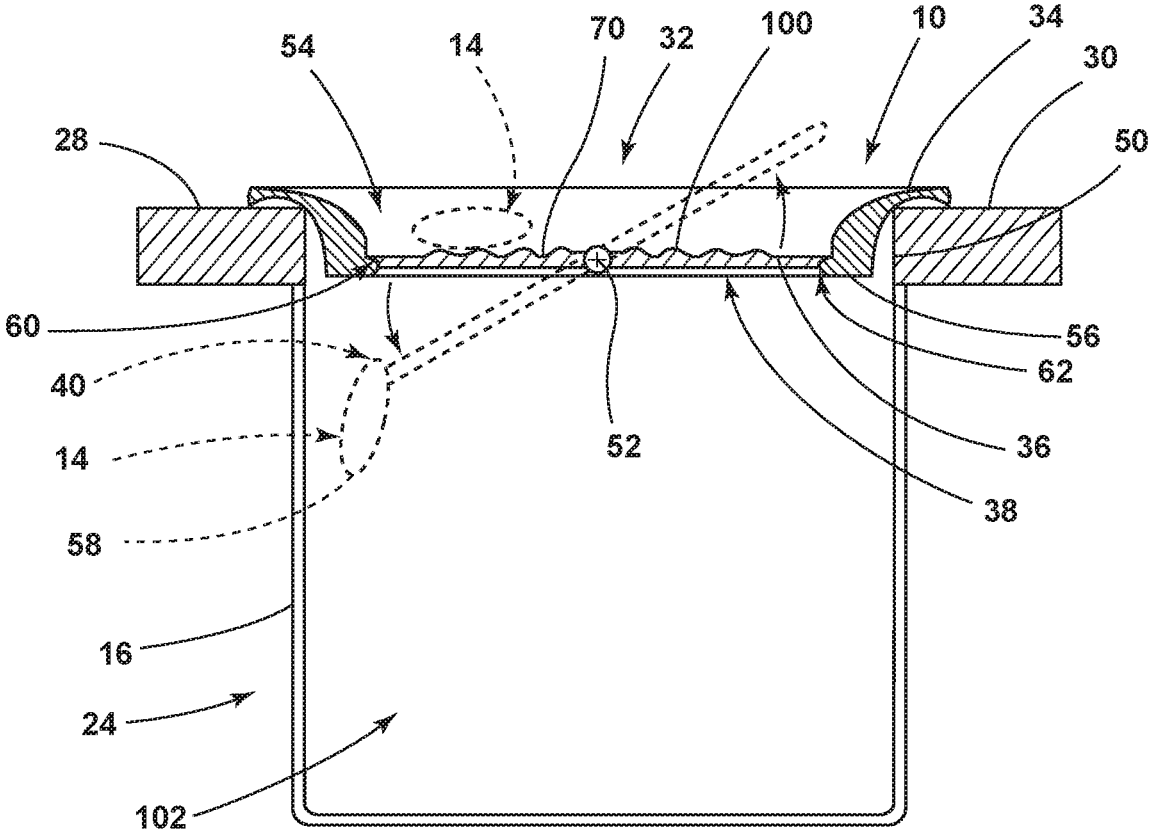
FIG. 8 is a cross-sectional view of the laundry appliance of FIG. 6 taken along line VIII-VIII.

As exemplified in FIG. 2, the pretreat basin 10 can be attached to an outer cabinet 18 of the appliance 12 when not in use. This attachment can be accomplished through a hanging attachment, magnetic attachments, and other similar attaching mechanisms.

According to various aspects of the device, the rotating central portion 36 can be manipulated into the sealed position 38 and maintained in this position through various magnets, or magnets in combination with various ferromagnetic materials. These magnets and the ferromagnetic materials can be positioned within one or both of the rotating central portion 36 and the outer frame 34 or the pivot-retaining frame 122 for allowing for selective engagement between the outer edge 58 of the rotating central portion 36 and the inner perimeter 60 of the outer frame 34 or the pivot-retaining frame 122. This engagement can also be accomplished through various tabs, interference mechanisms, friction-type fittings, and other similar sealing-type engagements.

According to various aspects of the device, the pretreat basin 10 described herein is typically used within vertical axis washing machines. This device can also be used within a vertical axis combination washing/drying machine as well as other laundry appliances 12 that include a top-load feature, such as a secondary washing space or a horizontal axis machine with a top-load configuration. It is contemplated that the pretreat basin 10 can be sized to work within a vertical axis washing machine, and also operate within various household or commercial sinks, tubs 26, and other household fixtures as a secondary purpose for the pretreat basin 10. It should be understood that the exact shape and configuration of the pretreat basin 10 may depend on the size and configuration of the laundry appliance 12 within which the pretreat basin 10 is being disposed. Various locations of the fluid ports 80, sizes of the top panel 20, the aperture 22 and the balancing ring 28 can also determine the exact size and shape of a pretreat basin 10 for use with the particular laundry appliance 12. These various combinations can be implemented without varying from the inventive concept of the device, as described herein.

According to another aspect of the present disclosure, a laundry appliance includes an outer cabinet having a top panel that defines an aperture for accessing an interior of the cabinet. A tub is positioned within the outer cabinet and below the aperture. A rotating drum disposed within the tub. A pretreat basin is selectively positioned in an installed position relative to the top panel and above the drum. The pretreat basin has an outer frame and a pivoting central portion that rotationally operates within the outer frame between a sealed position defined by the pivoting central portion being in alignment with the outer frame and a rotated position defined by the pivoting central portion being rotated out of alignment with the outer frame.

According to another aspect, the installed position is further defined by the outer frame selectively resting on one of the top panel and a balancing ring of the rotating drum. The outer frame in the installed position is stationary relative to the top panel.

According to yet another aspect, an opening into the drum is defined by the balancing ring and the pretreat basin is coupled with the balancing ring in the installed position.

According to another aspect of the present disclosure, the pretreat basin is disposed on the top panel of the appliance in the installed position.

According to another aspect, the installed position is further defined by the pivoting central portion of the pretreat basin being positioned below a top surface of the drum and within a processing chamber of the drum.

According to yet another aspect, the pivoting central portion is at least partially translucent.

According to another aspect of the present disclosure, the pretreat basin includes a sidewall that extends between the outer frame and the pivoting central portion.

According to another aspect, the sidewall is a flexible member that is adjustable between a collapsed position and an expanded position.

According to yet another aspect, the flexible member extends between the outer frame and a pivot-retaining frame. The pivoting central portion is rotationally coupled with the pivot-retaining frame.

According to another aspect of the present disclosure, the pivoting central portion includes a textured surface.

According to another aspect, a laundry appliance includes an outer cabinet having a top panel that defines an aperture for accessing an interior of the cabinet. A tub is positioned within the interior and below the aperture. A rotating drum is disposed within the tub. The rotating drum has a balancing ring at a top edge of the drum and proximate the aperture. A pretreat basin is selectively positioned in an installed position on one of the top panel and the balancing ring. The pretreat basin has an outer frame and a pivoting central portion that rotationally operates within the outer frame between an aligned sealed position and an oblique rotated position.

According to yet another aspect, the installed position is further defined by the pivoting central portion of the pretreat basin being positioned below a top surface of the drum and within a processing chamber of the drum.

According to another aspect of the present disclosure, the pretreat basin includes a sidewall that extends between the outer frame and the pivoting central portion.

According to yet another aspect, the sidewall is a flexible member that is adjustable between a collapsed position and an expanded position.

According to another aspect of the present disclosure, a pretreat basin for a laundry appliance includes an outer frame that is selectively positioned over a processing chamber of said laundry appliance. A pivoting central portion is rotationally disposed within the outer frame and rotates about a pivot axis. The pivoting central portion rotationally operates between a sealed position characterized by the pivoting central portion being in alignment with the outer frame and a rotated position characterized by the pivoting central portion being rotated out of alignment with the outer frame. A sidewall extends between the outer frame and the pivoting central portion.

According to another aspect, the pivoting central portion is at least partially translucent.

According to yet another aspect, the sidewall is a flexible member that is adjustable between a collapsed position and an expanded position.

According to another aspect of the present disclosure, the sidewall includes a plurality of pleats that selectively unfurl and operate the pivoting central portion between the collapsed and expanded positions.

According to another aspect, the flexible member extends between the outer frame and a pivot-retaining frame. The pivoting central portion is rotationally coupled with the pivot-retaining frame.

According to yet another aspect, the pivoting central portion includes a textured surface.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

an outer cabinet having a top panel that defines an aperture for accessing an interior of the outer cabinet;

a tub positioned within the outer cabinet and below the aperture;

a rotating drum disposed within the tub; and a pretreat basin that is selectively positioned in an installed position relative to the top panel and above the rotating drum, the pretreat basin having an outer frame and a pivoting central portion that rotationally operates within the outer frame between a sealed position defined by the pivoting central portion being in alignment with the outer frame and a rotated position defined by the pivoting central portion being rotated out of alignment with the outer frame, wherein the pivoting central portion rotates about a pivot axis that extends through a center of the pivoting central portion, and wherein the rotated position of the pivoting central portion is characterized by the pivoting central portion extending through the outer frame in an oblique orientation.

2. The laundry appliance of claim 1, wherein the installed position is further defined by the outer frame selectively resting on one of the top panel and a balancing ring of the rotating drum, wherein the outer frame in the installed position is stationary relative to the top panel.

3. The laundry appliance of claim 2, wherein an opening into the rotating drum is defined by the balancing ring and the pretreat basin is coupled with the balancing ring in the installed position.

4. The laundry appliance of claim 1, wherein the pretreat basin in the installed position is disposed on the top panel of the outer cabinet.

5. The laundry appliance of claim 1, wherein the installed position is further defined by the pivoting central portion of the pretreat basin being positioned below a top surface of the rotating drum and within a processing chamber of the rotating drum.

6. The laundry appliance of claim 1, wherein the pivoting central portion is at least partially translucent.

7. The laundry appliance of claim 1, wherein the pretreat basin includes a sidewall that extends between the outer frame and the pivoting central portion.

8. The laundry appliance of claim 7, wherein the sidewall is a flexible member that is adjustable between a collapsed position and an expanded position.

9. The laundry appliance of claim 8, wherein the flexible member extends between the outer frame and a pivot-retaining frame, wherein the pivoting central portion is rotationally coupled with the pivot-retaining frame.

10. The laundry appliance of claim 1, wherein the pivoting central portion includes a textured surface.

11. A laundry appliance comprising:

an outer cabinet having a top panel that defines an aperture for accessing an interior of the outer cabinet;

a tub positioned within the interior and below the aperture;

a rotating drum disposed within the tub, the rotating drum having a balancing ring at a top edge of the rotating drum and below the aperture; and a pretreat basin that is selectively positioned in an installed position on one of the top panel and the balancing ring, the pretreat basin having an outer frame and a pivoting central portion that rotationally operates within the outer frame between an aligned sealed position and an oblique rotated position, and wherein a pivot axis of the pivoting central portion extends centrally through the pivoting central portion and wherein the pivoting central portion extends obliquely through the outer frame in the oblique rotated position.

12. The laundry appliance of claim 11, wherein the installed position is further defined by the pivoting central portion of the pretreat basin being positioned below a top surface of the rotating drum and within a processing chamber of the rotating drum.

13. The laundry appliance of claim 11, wherein the pretreat basin includes a sidewall that extends between the outer frame and the pivoting central portion.

14. The laundry appliance of claim 13, wherein the sidewall is a flexible member that is adjustable between a collapsed position and an expanded position.

15. A pretreat basin for a laundry appliance, the pretreat basin comprising:

an outer frame that is selectively positioned over a processing chamber of said laundry appliance;

a pivoting central portion that is rotationally disposed within the outer frame and rotates about a pivot axis, wherein the pivoting central portion rotationally operates between a sealed position characterized by the pivoting central portion being in alignment with the outer frame and an oblique rotated position characterized by the pivoting central portion being rotated out of alignment with the outer frame, and wherein the pivoting central portion extends obliquely through the outer frame when the pivoting central portion is rotated into the oblique rotated position; and a sidewall that extends between the outer frame and the pivoting central portion.

16. The pretreat basin of claim 15, wherein the pivoting central portion is at least partially translucent.

17. The pretreat basin of claim 15, wherein the sidewall is a flexible member that is adjustable between a collapsed position and an expanded position.

18. The pretreat basin of claim 17, wherein the sidewall includes a plurality of pleats that selectively unfurl and operate the pivoting central portion between the collapsed and expanded positions.

19. The pretreat basin of claim 17, wherein the flexible member extends between the outer frame and a pivot-retaining frame, wherein the pivoting central portion is rotationally coupled with the pivot-retaining frame at the pivot axis, wherein the pivot axis extends centrally through the pivoting central portion.

20. The pretreat basin of claim 15, wherein the pivoting central portion includes a textured surface.

* * * * *